US007647003B2

(12) United States Patent
Itabashi

(10) Patent No.: US 7,647,003 B2
(45) Date of Patent: Jan. 12, 2010

(54) IMAGE FORMING APPARATUS HAVING A DRAWER AND A DRAWER LOCK

(75) Inventor: Nao Itabashi, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 350 days.

(21) Appl. No.: 11/470,044

(22) Filed: Sep. 5, 2006

(65) Prior Publication Data

US 2007/0053716 A1 Mar. 8, 2007

(30) Foreign Application Priority Data

Sep. 2, 2005 (JP) ..... 2005-254656

(51) Int. Cl.
*G03G 21/16* (2006.01)

(52) U.S. Cl. ..... 399/110

(58) Field of Classification Search ..... 399/107, 399/110, 111, 113; 312/215
See application file for complete search history.

(56) References Cited

U.S. PATENT DOCUMENTS 5,515,143 A 5/1996 Shiotani
2006/0228131 A1* 10/2006 Kimura et al. ..... 399/111

FOREIGN PATENT DOCUMENTS

| | | | |
|---|---|---|---|
| JP | 04184360 A | * | 7/1992 |
| JP | 05044370 A | * | 2/1993 |
| JP | 05257340 A | * | 10/1993 |
| JP | 11-095515 A | | 4/1999 |
| JP | 2000-039827 A | | 2/2000 |
| JP | 2001-027847 A | | 1/2001 |
| JP | 2004-109886 A | | 4/2004 |

OTHER PUBLICATIONS

Machine translation of JP 05257340.*

* cited by examiner

*Primary Examiner*—David M Gray
*Assistant Examiner*—Andrew V Do
(74) *Attorney, Agent, or Firm*—Banner & Witcoff, Ltd.

(57) ABSTRACT

An image forming device is provided that may have a housing with an opening, a drawer component that may be drawn out in a substantially horizontal direction through the opening, a holding portion on the housing to be held at a time when the drawer component is drawn out, and a drawer lock that can be switched between a locked state in which movement of the drawer component is locked in the direction of being drawn out at least at the beginning of being drawn out, and a released state in which there is no prohibition against moving in the direction of being drawn out.

19 Claims, 8 Drawing Sheets

IMAGE FORMING APPARATUS HAVING A DRAWER AND A DRAWER LOCK

CROSS REFERENCE TO RELATED APPLICATIONS

This application claims priority from Japanese patent application no. 2005-254656 filed Sep. 2, 2005, the entire contents of which are incorporated herein by reference.

FIELD

Aspects of the present invention relate to an image forming device and, more particularly, to reducing the possibility that the image forming device will incline when a removable component is drawn out of the image forming device.

BACKGROUND

Known image forming devices allow a user to draw out a drawer component in a substantially horizontal direction in relation to the main body of the image forming device. The drawer component may include multiple image forming units that form images on the surface of a recording medium. The multiple image forming units are detachable from the drawer component so that image forming units can be replaced.

This type of drawer component, however, requires force to be used to draw out the drawer component since the drawer component supports the group of relatively heavy image forming units. Therefore, the main body of the image forming device may tend to incline (or tilt forward) due to the shift in weight when the drawer component is drawn out of the main body of the image forming device.

As the drawer component is drawn out of the main body of the conventional image forming device, the center of gravity of the image forming device moves toward the outside of the main body of the image forming device in a substantially horizontal direction. Accordingly, the entire image forming device may tend to incline or tilt forward due to the forward movement of the center of gravity of the image forming device.

There is some possibility that the same thing (the forward tilt of the image forming device) will happen at a time, not only when a drawer component holding a number of image forming units, but also when any drawer component holding a relatively large and heavy element is drawn out of the main body of the image forming device.

SUMMARY

This summary is provided to introduce a selection of concepts in a simplified form that are further described below in the Detailed Description. This summary is not intended to identify key features or essential features of the claimed subject matter.

Aspects of the present invention relate to reducing the possibility that an image forming device will incline or rotate or tilt forward when a drawer component is drawn out of the device. An image forming device according to one or more aspects of the invention may have a housing with an opening, a drawer component that can be drawn out through the opening in a substantially horizontal direction, a holding portion on the housing that may be grasped when the drawer component is drawn out, and a drawer lock that can be switched between a locked state and a released state. While in the locked state, movement of the drawer component through the opening is at least initially prevented. While in the released state, movement of the drawer component through the opening is not hampered. The drawer lock may have a controlling element arranged in such a way that the controlling element is operable by a user at the same time the holding portion is grasped. Here, the drawer lock is in the released state when the controlling element is engaged; the drawer lock is in the locked state when the controlling element is not engaged.

These and other aspects of the disclosure will be apparent upon consideration of the following detailed description of illustrative embodiments.

BRIEF DESCRIPTION OF THE DRAWINGS

A more complete understanding of the present invention and the potential advantages thereof may be acquired by referring to the following description of illustrative embodiments in consideration of the accompanying drawings.

DETAILED DESCRIPTION

The various aspects summarized previously may be embodied in various forms. The following description shows by way of illustration of various combinations and configurations in which the aspects may be practiced. It is understood that the described aspects and/or embodiments are merely illustrative examples, and that other aspects and/or embodiments may be utilized and structural and functional modifications may be made, without departing from the scope of the present disclosure.

It is noted that various connections are set forth between elements in the following description. It is noted that these connections in general and, unless specified otherwise, may be direct or indirect and that this specification is not intended to be limiting in this respect.

1. The Overall Structure of an Illustrative Color Laser Printer

Figure 1:
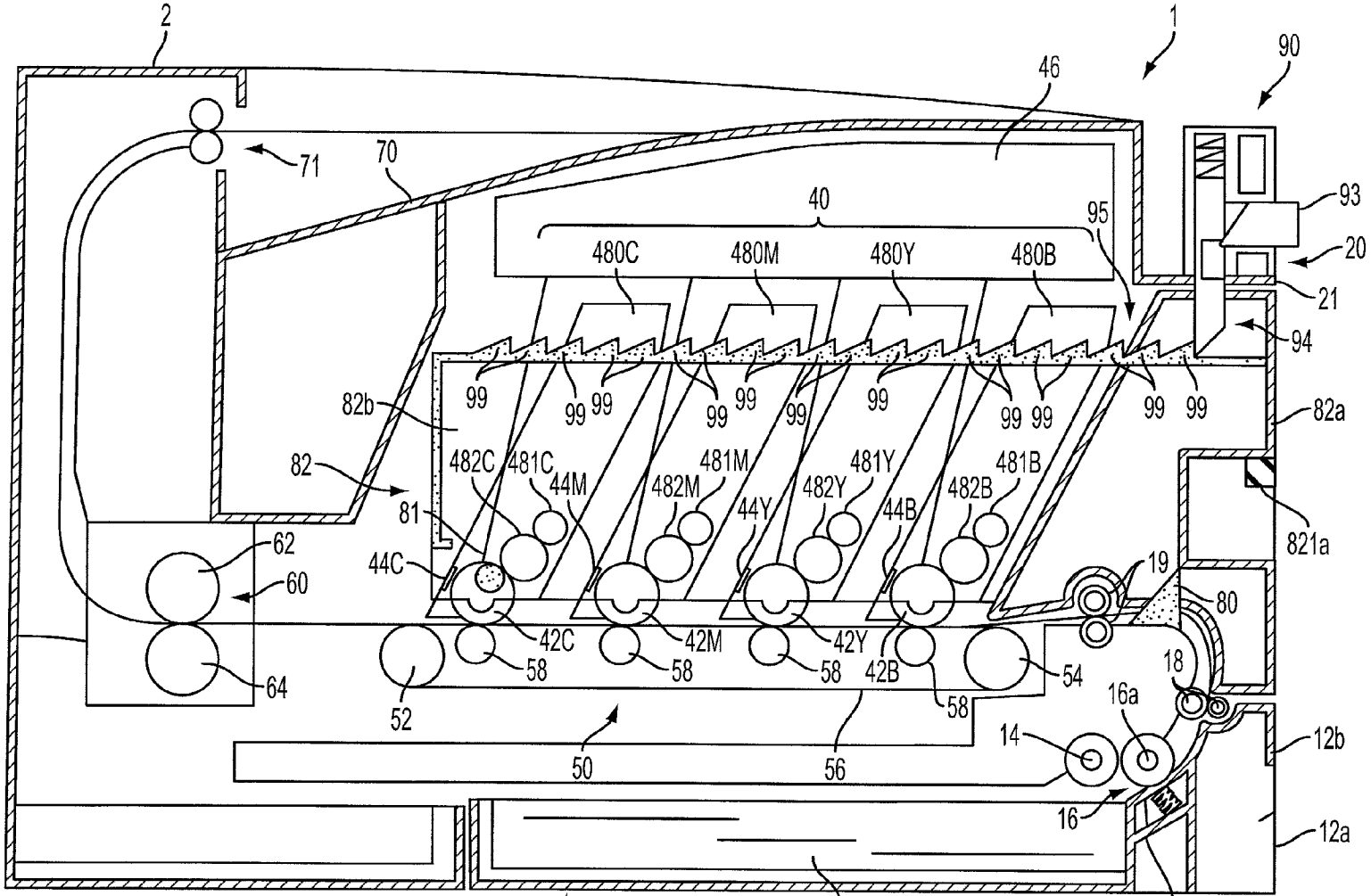
FIG. 1 is a side cross-section showing an illustrative embodiment of a color laser printer used as an illustrative example of an image forming device according to aspects of the present invention.

FIG. 1 is a central sectional view of an illustrative example of an image forming device, such as a color laser printer 1 in a working illustrative example 1. In FIG. 1, the vertical direction corresponds to the vertical direction of the color laser printer 1, the horizontal direction corresponds to the horizontal direction of the color laser printer 1, the direction toward the front of the printer corresponds to the direction toward the right of FIG. 1, and the direction toward the rear of the printer corresponds to the direction toward the left of FIG. 1.

The printer 1 is shown as a color laser printer operating via a direct tandem method. As shown in FIG. 1, the printer 1 is an image forming device equipped with a paper cassette 12 as the second drawer component, a paper feeding roller 14, a paper separation portion 16, a guide 18, a resist roller 19, a group of image forming units 40, a process casing 82 (as the first drawer component), a drawer lock, a scanner 46, a transport unit 50, a fixing unit 60, and a discharge roller 71.

The paper cassette 12 fits within the housing and is open on the upper side. The paper cassette 12 is horizontally detachable and can store a recording medium, such as paper P. The paper cassette has a front sidewall 12*a* having a handle 12*b* for drawing the paper cassette 12 out of the main body of the printer 1.

The paper feeding roller 14 is located at the upper front end of the paper cassette 12 in such a way as to transport paper P stored in the paper cassette 12 downstream for further processing and transport (hereinafter referred to as the "downstream").

The paper separation portion 16 is located downstream from the paper feeding roller 14. The paper separation portion 16 includes a pickup roller 16*a* and a separation pad 16*b* placed opposite the pickup roller 16*a* and pressed toward the pickup roller 16*a*, so that each sheet of paper P can be separated from the remaining paper for transport. The guide 18 is placed downstream of the paper separation portion 16 so as to guide paper P sent from the paper separation portion 16. The resist roller 19, downstream of the guide 18, is used to send paper P to a group of image forming units 40 after correcting any oblique motions of paper P. A group of image forming units 40, downstream of the resist roller 19, create and transfer images to paper P sent from the guide 18. The process casing 82 is formed in a substantially box-shape and open on the upper side. The process casing 82 is configured to fit within the housing. The process casing 82 holds a group of individually removable image forming units 40.

A drawer lock 90 may be located in the upper front portion of the housing 2 of the printer 1. The drawer lock 90 may be used to prevent the process casing 82 from being drawn out of the printer 1. The transport unit 50 may be located below a group of image forming units 40. The transport unit 50 may be used to transport paper P sent from the guide 18 to a position in which images can be formed on the paper (referred to as a "print-through" position). The scanner 46 forms electrostatic latent images on photosensitive drums 42C, 42M, 42Y, and 42B.

The fixing unit 60 may be located downstream of the group of image forming units 40. The fixing unit 60 fixes the images formed on paper P by the group of image forming units 40 by heating and pressure. Downstream from the fixing unit 60, the discharge roller 71 discharges paper P to a discharge tray 70.

Arranged in the direction (the arrow of FIG. 1) of the transport of paper P as transported by transport unit 50, a group of image forming units 40 has four image forming units 40C, 40M, 40Y, and 40B that form images of cyan (C), magenta (M), yellow (Y), and black (B), respectively. Symbols with C, M, Y, and B after numbers are components making up image forming units 40C, 40M, 40Y, and 40B, respectively. Components with the same numbers have the same construction except for the colors of developed images.

Detailed description of 40M, 40Y, and 40B have been omitted below by using the image forming unit 40C as a representative case. The image forming unit 40C is equipped with a photosensitive drum 42C (temporarily holding electrostatic latent images), an electrostatic charger 44C (charging the photosensitive drum 42C), and a developing machine 48C (forming developed images by applying a developer to the photosensitive drum 42C). A polymerization toner may be used as the developer.

The electrostatic charger 44C (a scorotron type, for instance) is used to positively charge the surface of the photosensitive drum 42C uniformly by generating corona discharge from a charging wire. The charging wire may be made of tungsten or the like.

The developing machine 48C is equipped with a container 480C to contain a developer, a supply roller 481C to transport a developer from the container 480C, and a developing roller 482C to form developed images by supplying a developer transported from the supply roller 481C to the surface of the photosensitive drum 42C while positively charging the developer.

The image forming units 40C, 40M, 40Y, and 40B are held in the process casing 82 in a detachable manner. The housing 2 of the printer 1 has a front sidewall 20 with the surface of the wall in the horizontal direction. At the center of the front sidewall 20 is an opening 21. The process casing 82 may be drawn out horizontally through the opening 21. The front sidewall 12*a* of the paper cassette 12 is part of the front sidewall 20.

The process casing 82 has a front sidewall 82*a* with a surface of the front sidewall 82*a* facing the front, and the right sidewall 82*b* and the left side wall (not shown) that surround the image forming units 40C, 40M, 40Y, and 40B. The right sidewall 82*b* of the process casing 82 is not supposed to be included in a central sectional view of the printer 1, because the right sidewall 82*b* is actually located at the right of the central portion of the printer 1. Nevertheless, the right sidewall 82*b* of the process casing 82 is shown in FIG. 1, a central sectional view of the printer 1, for the purpose of explanation. The image forming units 40C, 40M, 40Y, and 40B located at the left of the right sidewall 82*b* are also shown in FIG. 1. On the front sidewall 82*a* is a handle 821*a* furnished to draw out the process casing 82 out of the main body of the printer 1 toward the front in a substantially horizontal direction.

The construction of the left sidewall (not shown) of the process casing 82 is generally the same as the construction of the right sidewall 82*b* turned around the central portion of the printer 1. Accordingly, a detailed description of the left sidewall of the process casing 82 has been omitted by explaining only the right sidewall 82*b* as a representative case.

On the lower rear end of the surface of the right sidewall 82*b* is a protruding portion 81 equipped as a connecting portion that protrudes toward the right. On the guide 18 is a stopper 80 furnished to prevent the process casing 82 from completely coming out of the printer 1 by the stopper coming into contact with the protruding portion 81. There may also be a stopper 80 for the protruding portion 81 on the left sidewall of the process casing 82 as well.

The scanner 46 has a lens and a laser emitting device that emits a laser ray to form electrostatic latent images on the surfaces of the photosensitive drums 42C, 42M, 42Y, and 42B.

The transport unit 50 includes a driving roller 52 that rotates counterclockwise in FIG. 1 by receiving a driving force from a motor (not shown). The motor (not shown) in the printer 1 is placed downstream of the transport pathway of paper P. A driven roller 54 is placed in the upstream of the transport pathway of paper P. An endless belt 56 spans between the driving roller 52 and the driven roller 54. Four print-through rollers 58 are placed in the opposite sides of the photosensitive drums 42C, 42M, 42Y, and 42B with the belt 56 in between.

The fixing unit 60 has a heating roller 62 having halogen lamps along the axis of a metal pipe and a pressing roller to send paper P transported from the transport unit 50 to a discharge roller 71 while pressing paper between the pressing roller and the heating roller 62.

2. Illustrative Operation of the Color Laser Printer

After positively charging the surface of the photosensitive drum 42C uniformly using an electrostatic charger 44C, modulated laser light irradiates the surface of the photosensitive drum 42C using the scanner 46. The modulated laser light is modulated based on the information of images to be formed. The electric potential on the portion irradiated (exposed) by the laser ray declines. The result is the formation of electrostatic latent images on the surface of the photosensitive drum 42C.

When a positively charged developer is supplied to the surface of the photosensitive drum 42C from a developing machine 48C, the developer attaches only to the portion exposed on the surface of the photosensitive drum 42C. As a result, the electrostatic latent images are visualized as developed images.

By making the photosensitive drum 42C rotate about photosensitive drum 42C's own axis, the developed images are moved to the position facing the print-through roller 58 (print-through position). The same is performed for the image forming units 40M, 40Y, and 40B. Along with the above illustrative operation, paper P is transported toward the resist roller 19 through the paper feeding roller 14 and the paper separation portion 16. Paper P is held to the belt 56 driven by the driving roller 52 and transported to the print-through positions with the help of resist roller 19.

Along with the transport of paper P on the belt 56, a print-through bias is applied to the space between the four photosensitive drums 42C, 42M, 42Y, and 42B and the respective print-through rollers 58. In other words, color images are formed on paper P by printing the developed images in turn on the surface of the four photosensitive drums 40C, 40M, 40Y, and 40B onto the surface of paper P.

The developed images are fixed on the surface of paper P in the course of transporting paper P by making the pressing roller 64 rotate on pressing roller 64's axis in the fixing unit 60 while heating and pressing the paper at the same time. The paper P with the developed images fixed is discharged to a discharge tray 70 with the help of a discharge roller 71.

Figure 2B:
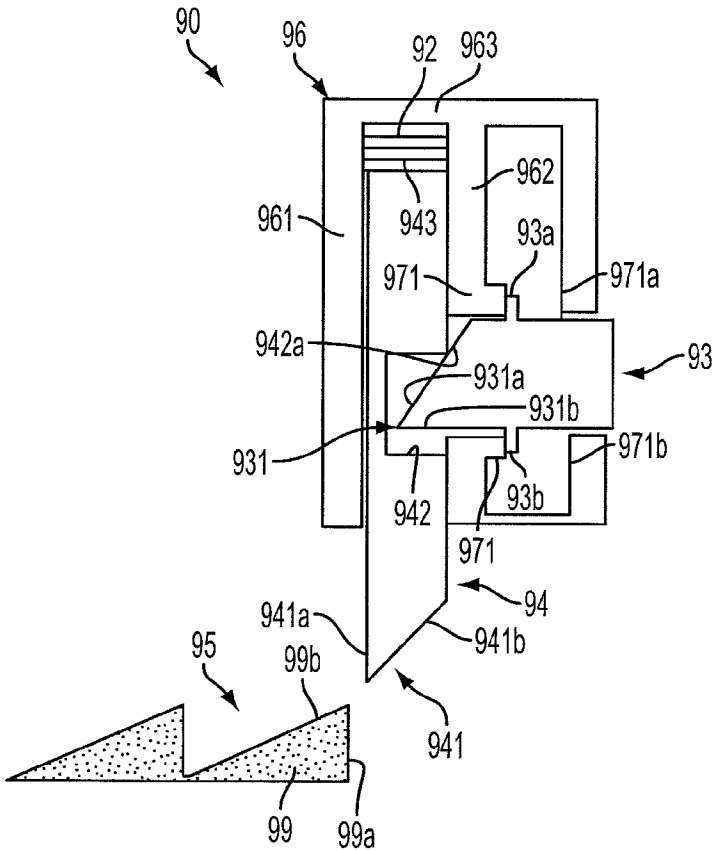
FIG. 2B is an enlarged sectional view of the drawer lock of FIG. 2A shown in a released state in accordance with aspects of the present invention.
Figure 2A:
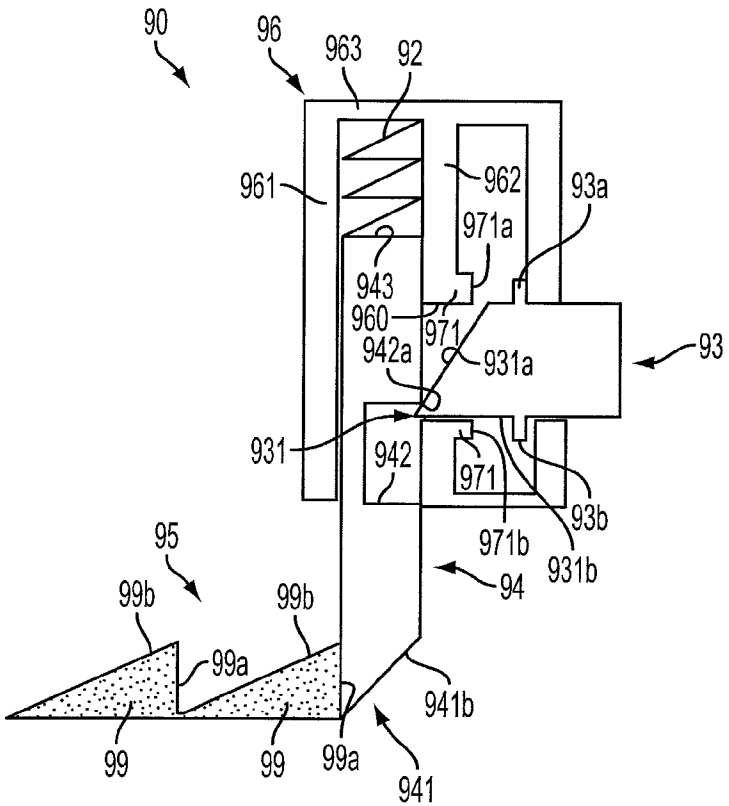
FIG. 2A is an enlarged sectional view of a first illustrative example drawer lock of the image forming device of FIG. 1 shown in a locked state in accordance with aspects of the present invention.

3. Illustrative Operation of the Printer Having a First Illustrative Example Drawer Lock FIG. 2A is an enlarged sectional view of the drawer lock 90 shown in a locked state. FIG. 2B is an enlarged sectional view of the drawer lock 90 shown in a released state. Both FIGS. 2A and 2B, however, omit part of a engaged element 95.

As shown in FIGS. 2A and 2B, the drawer lock 90 is equipped with a engaging element 94 in the housing 2 of printer 1. Engaged element 95 prevents the process casing 82 from being drawn out by the engaged element 95 making contact with the engaging element 94 of the process casing 82. A spring 92 acts as a bias to push the engaging element 94 toward the engaged element 95. A controlling element 93 is arranged in such a way as to link with the engaging element 94. A guide wall 96 supports the engaging element 94 so that the engaging element 94 can slide vertically (for instance). A guide wall 971 for the controlling element supports the controlling element 93 so that the controlling element 93 can slide in the front-rear direction.

The controlling element 93 may be part of other control elements that control the movement of engaging element 94 or process casing 82. Alternatively, controlling element 93 may be one of the last or the final component that engages engaging element 94 or process casing 82.

The engaging element 94 has a wedge-shaped engaging portion 941 having an edge extending downward on the bottom portion, a concaved portion 942 retreating in the opposite direction of the front surface, and a flat spring-fixing surface 943 on the upper end.

Contacting with the engaged element 95, the engaging portion 941 has a engaging surface 941*a* extending perpendicularly on the rear side and a contacting surface 941*b* on the front side diagonally extending upward while extends toward the front.

The concaved portion 942 is a rectangular-shaped hollow. The front edge of the upper surface of the concave 942 has a corner portion 942*a* that contacts the controlling element 93.

U-shaped guide wall 96 for the engaging element 94 has a first guide wall 961 for the engaging element 94 and a second guide wall 962 for the engaging element 94 that extend perpendicularly facing each other. Further, guide wall 96 includes a third guide wall 963 for the engaging element 94 connecting the upper portions of the first guide wall 961 and the second guide wall 962.

The guide wall 96 supports the engaging element 94 between the first guide wall 961 and the second guide wall 962 in such a way that the engaging element 94 can slide vertically.

On the second guide wall 962 for the engaging element is an opening 960 formed so that the concave 942 and the controlling element 93 can contact each other.

Fixed on a spring-fixing surface 943 on one end and on the third guide wall 963 on the other end, a spring 92 biases the engaging element 94 downward in the direction of the engaged element 95.

The controlling element 93 has a lifting portion 931 having a wedge-shaped edge extending toward the rear, a protrusion 93*a* protruding from the top surface, and a protrusion 93*b* protruding from the bottom surface.

On a guide wall 971 for the controlling element are slide holes 971*a* and 971*b* that extend from the opening 960 toward the front and hold the protrusion 93*a* and the protrusion 93*b* in such a way that those protrusions 93*a* and 93*b* can slide in the direction of the front and the rear within a fixed range.

The lifting portion 931 has a lifting surface 931*a* on the topside diagonally extending upward extending toward the front and a bottom surface 931*b* of the controlling element extending horizontally on the bottom side.

The lifting surface 931 is located in such a way as to contact corner portion 942*a* within the slidable range of the controlling element 93. Bringing the lifting surface 931 and the corner portion 942*a* into contact with each other makes it possible for the controlling element 93 and the engaging element 94 to link with each other.

As shown in FIG. 1, the engaged element 95 has a number (for example, 20) wedge-shaped engaged portions 99 may contact the engaging portion 941 on the upper end of the right sidewall 82*b* of the process casing 82. As shown in FIG. 2A and FIG. 2B, each of the engaged portions 99 has a engaged surface 99*a* extending perpendicularly on the front side and, next to engaged surface 99*a*, a contacted surface 99*b* on the rear side diagonally extending upward extending toward the front. The drawing out of the process casing 82 is prevented when the engaged surface 99*a* contacts the engaging surface 941*a* of the engaging portion 941. The engaged portions 99 are closely arranged side-by-side, leaving no space among them in the drawing out direction of the process casing 82. The first (front most) engaged portion 99 contacts the engaging portion 941*a* when the process casing 82 is placed in the printer 1. The rearmost engaged portion 99 is arranged so that the rearmost engaged portion 99 can contact the engaging portion 941*a* when the protrusion 81 and the stopper 80 come into contact with each other.

The left sidewall of the process casing 82 (not shown) is generally the same as in the right sidewall 82*a*.

4. Illustrative Operation of Drawer Lock 90

When the controlling element 93 is not in operation, the engaging element 94 is pushed downward by the force of the spring 92. Also, the controlling element 93 is pushed forward through the lifting surface 931*a* that contacts the corner portion 942*a* of the engaging element 94. As shown in FIG. 2A, as a result, the controlling element 93 is positioned where further forward movement is prevented by the slide holes 971*a* and 971*b*. The engaging element 94 positioned where the engaging element 94 contacts the engaged element 95. In other words, the engaging element 94 is placed in the locked position; and the drawer lock 90 is placed in the locked state. Here, the tip portion of the lifting surface 931*a* and the corner portion 942*a* contact each other.

When a user pushes the front surface of the controlling element 93 to push the controlling element 93 in toward the rear to a position where no further backward movement is possible (due to the slide holes 971*a* and 971*b*), the engaging element 94 is slid upward to a position where the engaging element 94 does not contact the engaged element 95 as shown in FIG. 2B, as a result of linking with the controlling element 93 through the corner portion 942*a* in contact with the lifting surface 931*a*. Here, the engaging element 94 is placed in the released position; and the drawer lock 90 is placed in the released state.

Figure 3A:
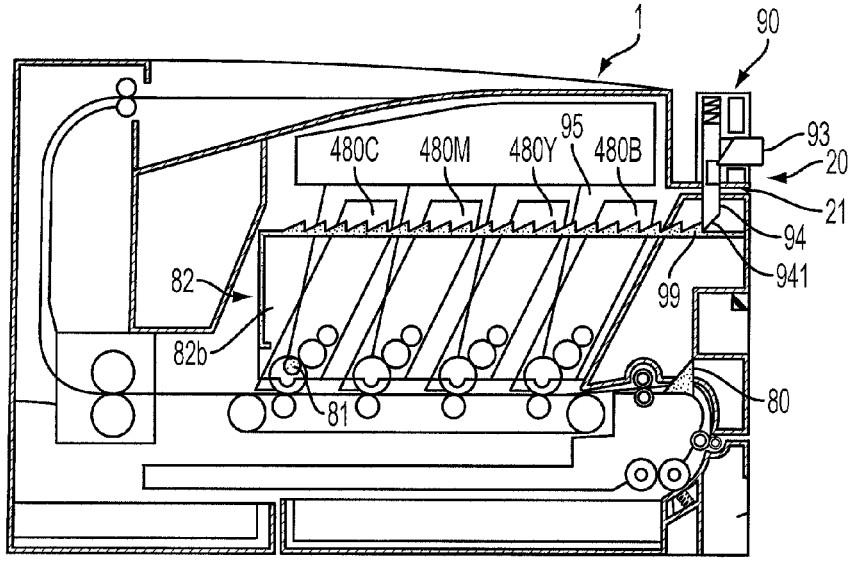
FIG. 3A is a sectional view of the image forming device of FIG. 1 showing the drawer lock of FIG. 2A in a locked state in accordance with aspects of the present invention.
Figure 3B:
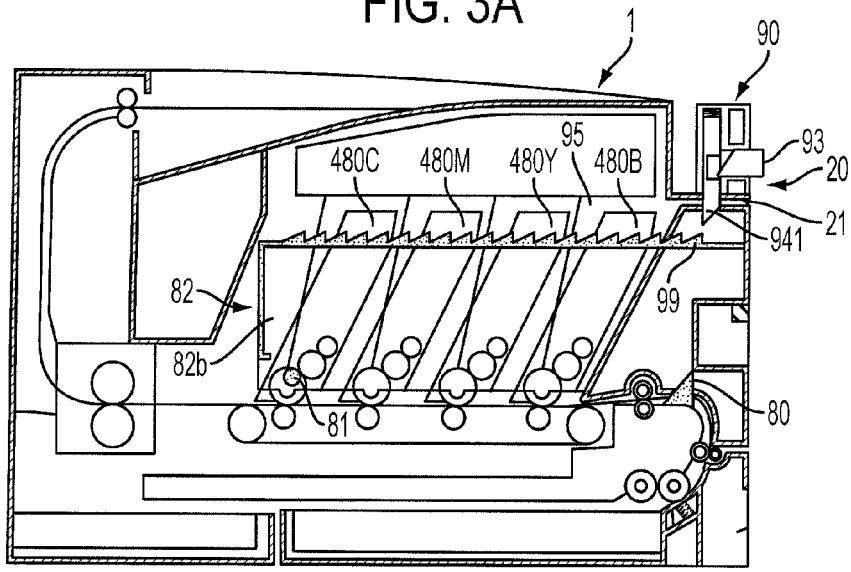
FIG. 3B is a sectional view of the image forming device of FIG. 1 showing the drawer lock of FIG. 2A in a released state in accordance with aspects of the present invention.
Figure 3C:
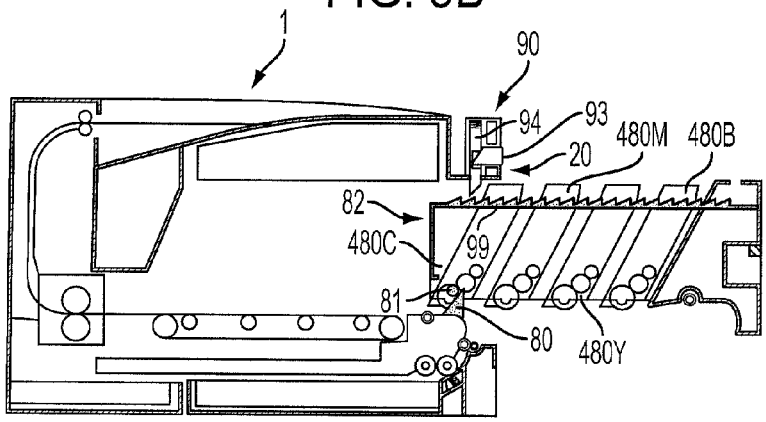
FIG. 3C is a sectional view of the image forming device of FIG. 1 showing a process casing in a drawn out state retained by the drawer lock of FIG. 2A in accordance with aspects of the present invention.

FIG. 3A is a sectional view of the printer 1 when the drawer lock 90 is in the locked state. FIG. 3B is a sectional view of the printer 1 when the drawer lock 90 is in the released state. FIG. 3C is a sectional view of the process casing 82 when it is drawn out and prevented from further movement by the stopper 80.

As shown in FIGS. 3A and 3B, when the process casing 82 is placed in the printer 1 and a user pushes the controlling element 93 toward the rear (that is, in the opposite of the drawing out direction), the contact between the engaging element 94 and the engaged element 95 is released. Also, the drawer lock 90 is placed in the released state. As a result, the process casing 82 is placed in a position where it can be drawn out. As shown in FIG. 3C, the user continues drawing out the process casing 82. As the user continues pushing in the controlling element 93, the stopper 80 and the protrusion 81 come into contact with each other and prevent further drawing out of the process casing 82. At this location, the user can remove each of the image forming units 40C, 40M, 40Y, and 40K from the process casing 82. It is appreciated that the user could have removed at least some of the image forming units before the stopper 80 contacted the protrusion 81.

If the operation of the controlling element 93 is stopped during a period from the start of drawing out of the process casing 82 until the stopper 80 and the protrusion 81 come into contact with each other, the engaging portion 941 comes into contact with one of the engaged portions 99 and prevents further drawing out of the process casing 82.

If the process casing 82 is further drawn out, the protrusion 81 rides over the stopper. This results with the front sidewall 82*a* of the process casing 82 inclines upward. As a consequence, the contacted surface 99*b* of the engaged portion 99 pushes up the contacting surface 941*b* of the engaging element 94. Finally, the process casing 82 can be completely removed from the printer 1.

When the process casing 82 is to be placed in the printer 1, the process casing 82 is slid in through the opening 21 of the printer 1 toward the rear. The contacting surface 941*b* of the engaging portion 941 and the contacted surface 99*b* of the contacted portion 99 come into contact with each other. As the process casing 82 moves, the engaging element 94 is pushed up against the force of the spring 92. As a result, the process casing 82 can be slid toward the rear.

When a user starts drawing out the process casing 82, the user pushes in the controlling element 93 in the direction opposite of the drawing out direction. Accordingly, the printer 1 is prevented from inclining despite a reaction caused by drawing out the process casing 82. In effect, by pushing controlling element 93, the user is shifting the center of gravity back toward the rear of the printer 1.

Since the engaging element 94 is pressed by the spring 92 toward the engaged element 95, the structure is relatively simple compared with a structure using a solenoid as a biasing system. Here, the engaging element 94 can easily be placed in the locked position whenever the operation of the controlling element 93 is finished.

Since the contact between the engaging portion 941 and the engaged portion 99 prevents the process casing 82 from being drawn out, the function for the prevention of drawing out hardly declines even after some abrasion occurs as compared with devices using a friction-type drawing out system; therefore, it is possible to use the device for a long period.

The possibility that the printer 1 inclines (or tilts or rotates) is reduced when the engaging element 94 is in the locked position during a period from the beginning of the process casing being drawn out until the stopper prevents the process casing 82 from moving in the drawing out direction. This is because the process casing 82 is prevented from moving in the drawing out direction during that period.

Since the opening 21 is formed on the front sidewall having the surface of the wall in the horizontal direction, the process casing 82 can be easily drawn out.

Since the controlling element 93 is placed on the front sidewall 20 having the opening 21, a user can easily view the controlling element 93.

The controlling element 93 is placed above the opening 21. The rotation of the printer 1 (the tendency for the printer 1 to incline) results in the controlling element 93 being more displaced than opening 21. In other words, there is a greater moment arm at the location of controlling element 93 than at opening 21. Because of the greater moment arm at the location of controlling element 93 and the user is pressing 93 in the direction opposite of the direction of inclination, the inclination of the printer 1 can be prevented. In the printer 1, a user cannot draw out the first drawer component unless the user pushes in the controlling element in the direction opposite of the drawing out direction at the beginning of the first drawer component being drawn out. As a result, the user can prevent the image forming device from inclining despite the forward shift in the center of gravity when the first drawer device is initially drawn out. There is a good chance that the user continues pushing in the controlling element afterward as well in consideration of the possibility of the inclination of the image forming device while the first drawer component is kept being drawn out; therefore the user can prevent the inclination of the image forming device from occurring.

As described above, the engaging element 94 is arranged in such a way that the engaging element 94 can be changed between the locked position (in which the movement in the drawing out direction of the first drawer component is prevented by the engaging element 94 making contact with the engaged element 95 at least at the beginning of drawing out) and the released position (in which the prohibition of moving in the drawing out direction the first drawer component is released by the engaging element 94 being separated from the engaged element 95). The drawer lock bias enables the engaging element 94 to move to the locked position; and the engaging element 94 is linked the controlling element 93 so that engaging element 94 can move to the released position against the force of the bias at a time when the controlling element 93 is placed into operation.

Such a structure, despite a relatively simple structure, makes it possible to bring the engaging element 94 into the locked position when the controlling element 93 is not operated. This is because the engaging element 94 is forced toward the locked position via the bias of spring 92.

As also described above, the first drawer component has a stopping structure (80, 81) that prevents the first drawer component from completely coming out of the main body of the image forming device. The stopping structure has a stopper 80 equipped on the housing as well as a contacting component 81 in the first drawer component in such a way that this structure prevents the first drawer component from completely coming out of the device at a time when the contacting component 81 contacts the stopper 80. The drawer lock is arranged in such a way that the movement in the direction of drawing out the first drawer component is prohibited in the locked state for a period from initially drawing out the first drawer component until the stopper 80 and the contacting component 81 come into contact with each other.

Such a structure makes it possible to reduce the chance that the image forming device inclines from the beginning of drawing out the first drawer component until the stopping structure stops the movement of the first drawer component in the drawing out direction.

As further described above, the controlling element 93 is formed on the sidewall upon which the opening is also formed. Such a structure makes it possible for a user to look at the controlling element 93 at the time of drawing out. As shown in FIG. 1, the controlling element 93 is formed above the opening. Such a structure makes it possible to hold an area above the opening that tends to incline more compared with the opening, which leads to a better prevention of inclination (or tilting as described above).

As further shown in FIG. 1 and described above, the first drawer component has one or more of image forming units (40C, 40M, 40Y, and 40B). In such a structure, the image forming units are arranged in such a way that they can be pulled out of the main body of the image forming device when the first drawer component is drawn out.

Figure 4B:
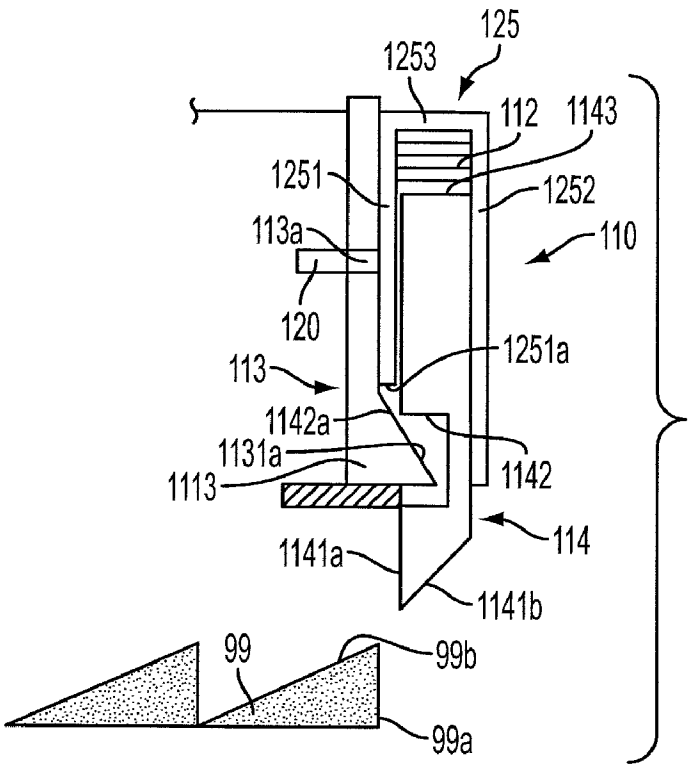
FIG. 4B is an enlarged sectional view of the drawer lock of FIG. 4A shown in a released state in accordance with aspects of the present invention.
Figure 4A:
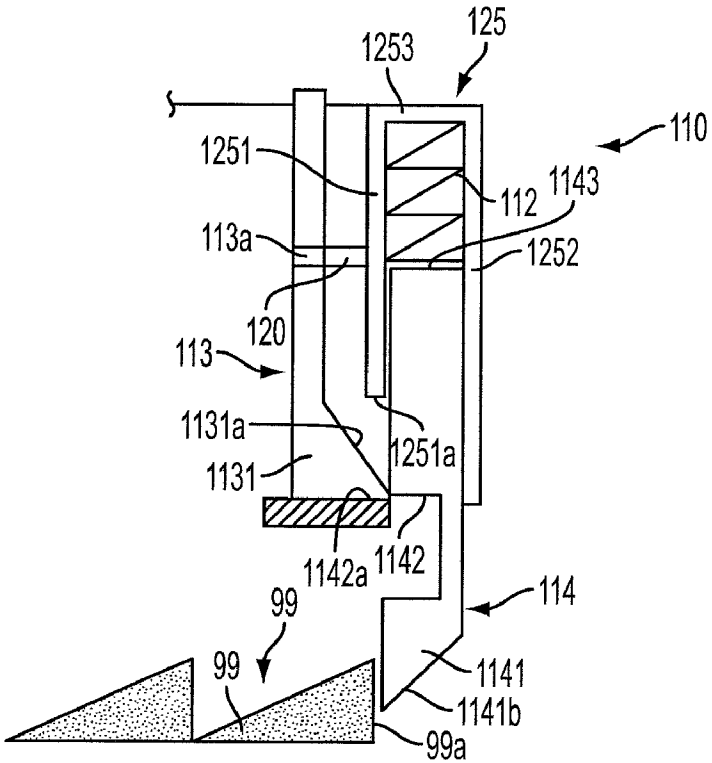
FIG. 4A is an enlarged sectional view of a second illustrative example drawer lock of the image forming device of FIG. 1 shown in a locked state in accordance with aspects of the present invention.

5. Illustrative Operation of the Printer 1 Having a Second Illustrative Example Drawer Lock FIG. 4A is an enlarged sectional view of a second illustrative example drawer lock 110 in which the drawer lock 110 is in the locked state. FIG. 4B is an enlarged sectional view of a drawer lock 110 in which the drawer lock 110 is in the released state.

As shown in FIGS. 4A and 4B, the drawer lock 110 is equipped with a engaging element 114 formed in the housing 2 of the printer 1. The engaged element 95 placed in the process casing 82 prevents the process casing 82 from being drawn out by the engaged element coming into contact with the engaging element 114. Spring 112 acts as a bias that pushes the engaging element 94 toward the engaged element 95. A controlling element 113 is formed in such a way as to link with the engaging element 114. A holding section 125 is to be held by a user to support the engaging element 114 so that the engaging element 114 can slide vertically.

As shown in FIGS. 4A and 4B, the engaging element 114 has a wedge-shaped engaging portion 1141 having an edge extending downward on the bottom portion, a concaved portion 1142 extending toward the front from the rear surface, and a flat spring-fixing surface 1143 on the upper end.

The engaging element 114 (contacting the engaged element 95) has a engaging surface 1141*a* extending perpendicularly on the rear side and a contacting surface 1141*b* on the front side diagonally extending upward and toward the front.

The concaved portion 1142 is a rectangular-shaped hollow. The rear edge of the upper surface of the concave 1142 has a corner portion 1142*a* that comes into contact with the controlling element 113.

The U-shaped holding portion 125 has the first guide wall 1251 and the second guide wall 1252 that extend perpendicularly facing each other as well as the third guide wall 1253 connecting the upper portions of the first guide wall 1251 and the second guide wall 1252.

The holding portion 125 supports the engaging element 114 between the first guide wall 1251 and the second guide wall 1252 in such a way that the engaging element 114 can slide vertically.

On the first guide wall 1251 is an opening 1251*a* formed so that the concave portion 1142 and the controlling element 113 can contact each other.

The controlling element 113 has a wedge-shaped lifting portion 1131 having a tip extending toward the front and protrusions 113*a* that each protrude from left and right surfaces. Channels 120 are formed on the surfaces facing a pair of protrusions 113*a* of the housing in the printer 1 to support the protrusions 113*a* so that the protrusions can slide in the direction of the front and the rear. Although only one protrusion 113*a* is shown in FIGS. 4A and 4B on the right side, the same is true for the left side as well. In FIGS. 4A and 4B, also only one channel 120 is shown that is formed on the surface facing the left side of the controlling element 113 of the housing in the printer 1. The same, however, is true for the channel 120 formed on the surface facing the right side of the controlling element 113 as well. Accordingly, the controlling element 113 can slide in the direction of the front and rear for the length of the channels 120.

The lifting portion 1131 has a lifting surface 1131*a* on the upper side diagonally extending downward while extending toward the front. The lifting surface 1131*a* is placed in such a way as to contact the corner portion 1142*a* all the times within the slidable range of the controlling element 113. Bringing the lifting surface 1131*a* and the corner portion 1142*a* into contact with each other makes it possible for the controlling element 93 and the engaging element 114 to engage with each other.

The holding portion 125 and the controlling element 113 are arranged in such a way that the rear surface of the controlling element 113 can be held by a user to operate the device at the same time the user holds the front surface of the second guide wall 1152 of the holding portion 125. As such, the user can hold and operate the device at the same time with one hand.

6. Illustrative Operation of Drawer Lock 110

When the controlling element 113 is not in operation, the engaging element 114 is pushed downward by the force of the spring 112, and the controlling element 113 is pushed backward through the lifting surface 1131*a* that contacts the corner portion 1142*a* of the engaging element 114. As shown in FIG. 4A, as a result, the controlling element 113 is stationed in a position where further backward movement is prevented by the channel 120. The engaging element 114 is stationed in a position where the engaging element 114 engages with the engaged element 95. In other words, the engaging element 114 is placed in the locked position and the drawer lock 110 is placed in the locked state. Here, the tip portion of the lifting surface 1131*a* of the controlling element 113 and the corner portion 1142*a* contact each other.

When a user operates the device by holding the holding portion 125 and the controlling element 113 simultaneously to push the controlling element 113 forward, the controlling element 113 is slid to a position where further forward movement is prevented by the channels 120. Since the engaging element 114 is linked with the controlling element 113 through the corner portion 1142*a* that contacts the lifting surface 1131*a*, the engaging element 114 is slid upward to a position where the engaged element 95 and the engaging element 114 no longer contact each other as shown in FIG. 4B. As a result, the engaging element 114 is placed in the released position, and the drawer lock 110 in the released state.

Figure 5A:
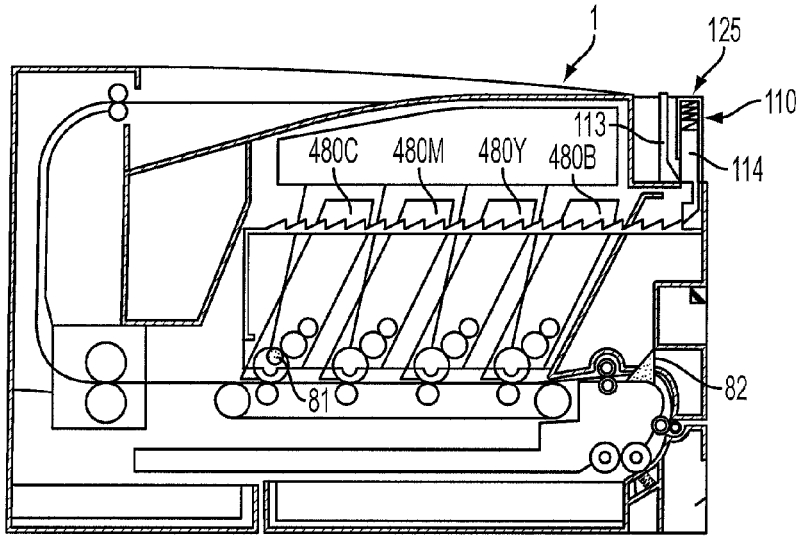
FIG. 5A is a sectional view of the image forming device of FIG. 1 showing the drawer lock of FIG. 4A in a locked state in accordance with aspects of the present invention.
Figure 5B:
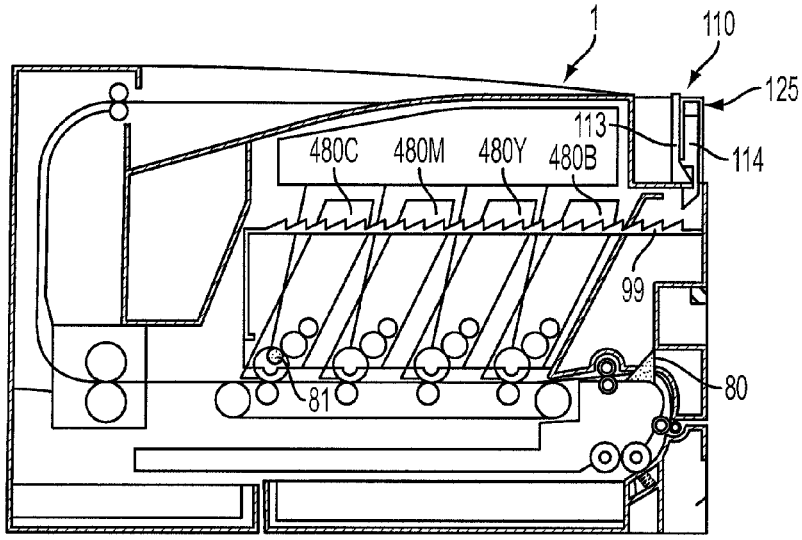
FIG. 5B is a sectional view of the image forming device of FIG. 1 showing the drawer lock of FIG. 4A in a released state in accordance with aspects of the present invention.
Figure 5C:
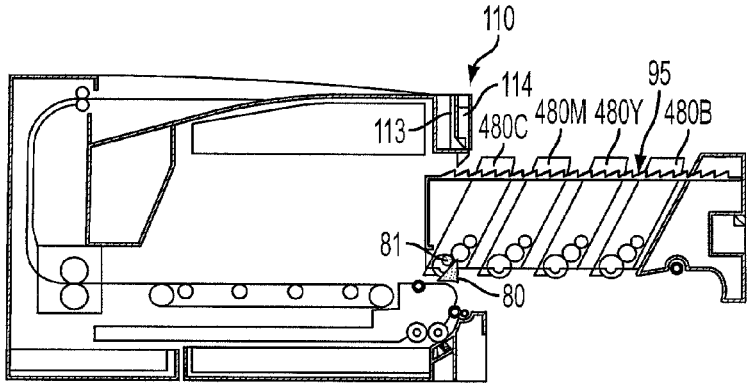
FIG. 5C is a sectional view of the image forming device of FIG. 1 showing a process casing in a drawn out state retained by the drawer lock of FIG. 4A in accordance with aspects of the present invention.

FIG. 5A is a sectional view of the printer 1 when the drawer lock 110 is positioned in the locked state. FIG. 5B is a sectional view of the printer 1 when the drawer lock 110 is positioned in the released state. FIG. 5C is a sectional view of the process casing 82 when drawn out and prevented from further movement by the stopper 80.

As shown in FIGS. 5A and 5B, when the holding portion 125 is held and the controlling element 113 is operated simultaneously to place the engaging element 114 into the released state, the process casing 82 can be drawn out. Contact between the stopper 80 and the protrusion 81 prevents the process casing 82 from further movement.

When a user starts drawing out the process casing 82, the user must hold the holding portion 125 and push in the controlling element 125 toward the front. Accordingly, the printer 1 is prevented from inclining (or rotating or tilting as described above) despite the forward shift in the center of gravity caused by drawing out the process casing 82. The possibility that the printer 1 inclines is reduced when the engaging element 114 is in the locked position during a period from the beginning of the process casing 82 being drawn out until the stopper prevents the process casing 82 from moving in the drawing out direction, because the process casing 82 is prevented from moving in the drawing out direction during that period.

In such a structure, a user cannot draw out the first drawer component unless the holding portion is held and the controlling element 125 is operated at the beginning of the first drawer component being drawn out. As a result, the user can prevent the image forming device from inclining/rotating/tilting despite the forward shift in the center of gravity when the first drawer device is initially drawn out. There is a good chance that the user continues holding the holding portion afterward as well in consideration of the possibility of the inclination of the image forming device while the first drawer component is kept being drawn out. Therefore, the user can prevent the inclination/tilting/rotation of the image forming device from occurring.

Figure 6B:
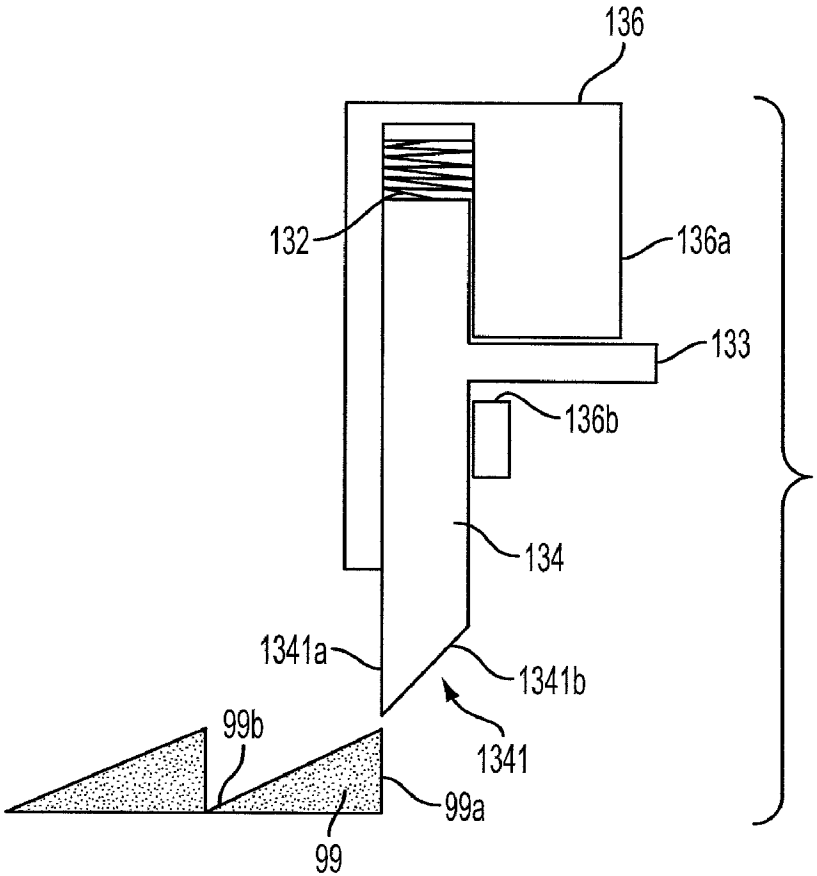
FIG. 6B is an enlarged sectional view of the drawer lock of FIG. 6A shown in a released state in accordance with aspects of the present invention.
Figure 6A:
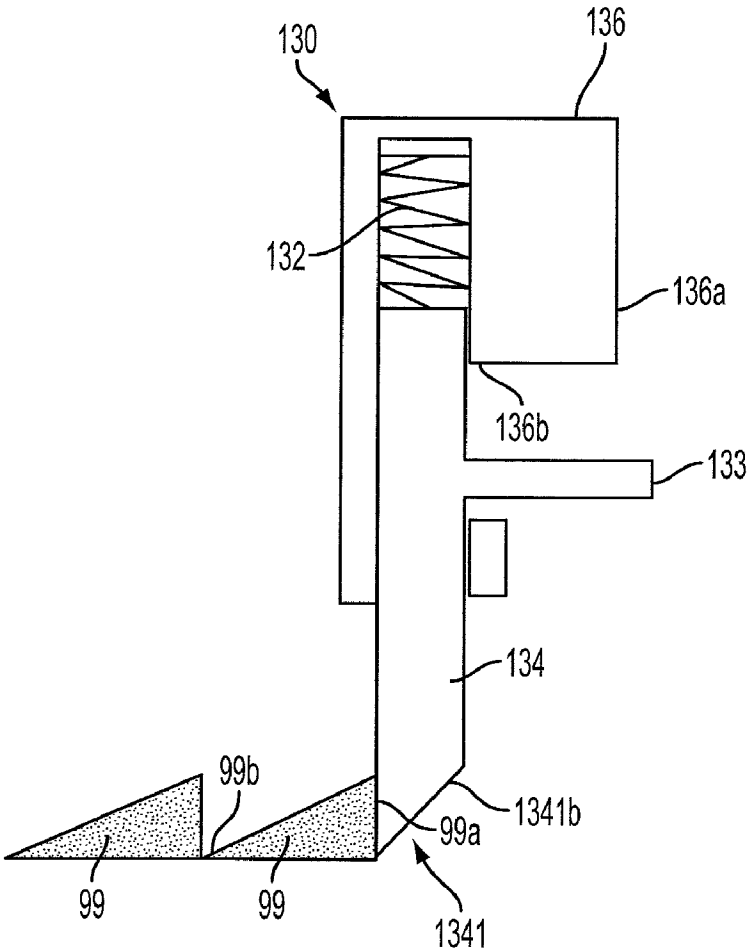
FIG. 6A is an enlarged sectional view of a third illustrative example drawer lock of the image forming device of FIG. 1 shown in a locked state in accordance with aspects of the present invention.

7. Illustrative Operation of the Printer Having a Third Illustrative Example Drawer Lock FIG. 6A is an enlarged sectional view of the drawer lock 130 when the drawer lock 130 is in the locked state. FIG. 6B is an enlarged sectional view of the drawer lock 130 when the drawer lock 130 is in the released state.

As shown in FIGS. 6A and 6B, the drawer lock 110 is equipped with a engaging element 134 formed in the housing 2 of the printer 1. The engaged element 95 is placed in the process casing 82 and prevents the process casing 82 from being drawn out by the engaged element 99 coming into contact with the engaging element 134. A spring 132 acts as a bias that pushes the engaging element 134 toward the engaged element 95. A controlling element 133 is integrally formed with the engaging element 134. A holding section 136 is provided to be held by a user to support the engaging element 134 so that the engaging element 134 can slide vertically.

As shown in FIGS. 6A and 6B, the engaging element 114 has a wedge-shaped engaging portion 1341 having an edge extending downward on the bottom portion and the controlling element 133 extending toward the front from the front side face.

Contacting the engaged element 95, the engaging element 134 has a engaging surface 1341*a* extending perpendicularly on the rear side and a contacting surface 1341*b* on the front side diagonally extending upward and toward the front.

The holding portion 136 is U-shaped and holds the engaging element 134 in such a way that the engaging element 134 can slide vertically. On the front sidewall 136*a* of the holding portion 136 is an opening 136*b* formed. The controlling element 133 is supported in the opening 136*b* so that the controlling element can slide vertically.

The spring 132 pushes the engaging element 134 downward.

The holding portion 136 and the controlling element 133 are arranged in such a way that the bottom surface of the controlling element 133 can be held by a user to operate the device at the same time the user holds the front sidewall 136*a* of the holding portion 136. As such, the user can hold and operate the device at the same time with one hand.

8. Illustrative Operation of Drawer Lock 130

When the controlling element 133 is not in operation, the engaging element 134 is pushed downward to the locked position by the force of the spring 132.

When a user operates the device by holding the front sidewall 136*a* of the holding portion 136 and the bottom surface of the controlling element 133 simultaneously, the controlling element 133 is moved upward. As a result, the engaging element 134 is placed in the released position.

Figure 7A:
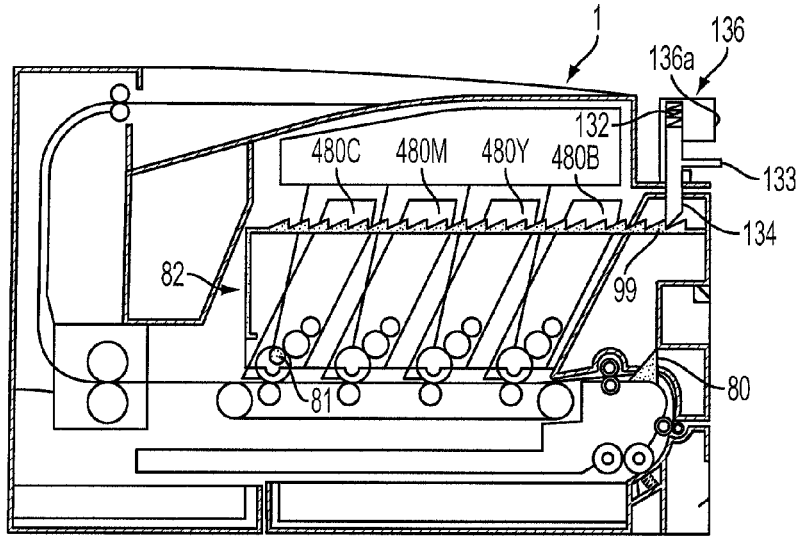
FIG. 7A is a sectional view of the image forming device of FIG. 1 showing the drawer lock of FIG. 6A in a locked state in accordance with aspects of the present invention.
Figure 7B:
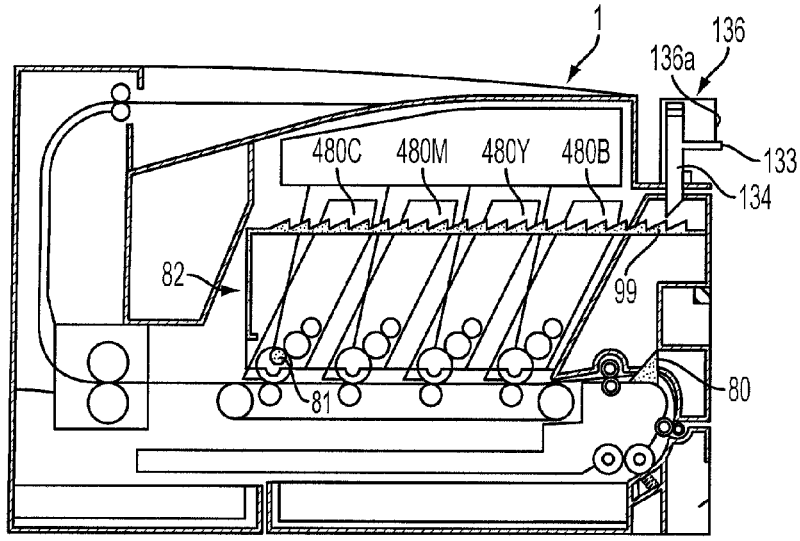
FIG. 7B is a sectional view of the image forming device of FIG. 1 showing the drawer lock of FIG. 6A in a released state in accordance with aspects of the present invention.
Figure 7C:
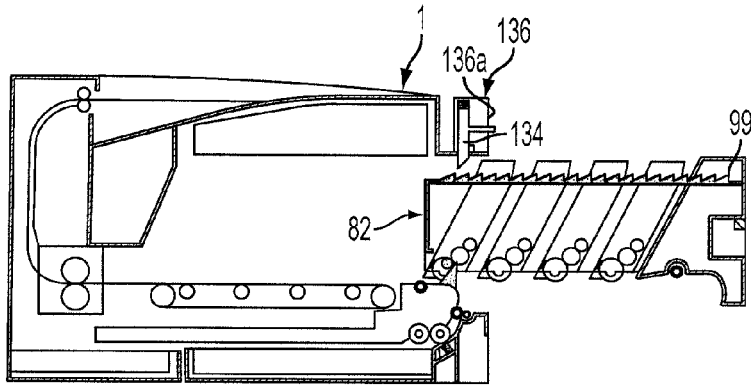
FIG. 7C is a sectional view of the image forming device of FIG. 1 showing a process casing in a drawn out state retained by the drawer lock of FIG. 6A in accordance with aspects of the present invention.

FIG. 7A is a sectional view of the printer 1 when the drawer lock 130 is positioned in the locked state. FIG. 7B is a sectional view of the printer 1 when drawer lock 130 is positioned in the released state. FIG. 7C is a sectional view of the process casing 82 when drawn out and prevented from further movement by the stopper 80.

As shown in FIGS. 7A and 7B, when the holding portion 136 is held and the controlling element 133 is lifted upward simultaneously to place the engaging element 134 into the released state, the process casing 82 can be drawn out. Contact between the stopper 80 and the protrusion 81 prevents the process casing 82 from further moving. Here, further detailed explanation is omitted since the rest remains the same as in the working example 1.

In such a structure, the engaging element 134 and the controlling element 133 are integrally formed. Therefore, it is easier to handle the drawer lock 130 than in the working example 2 described above.

Figure 8A:
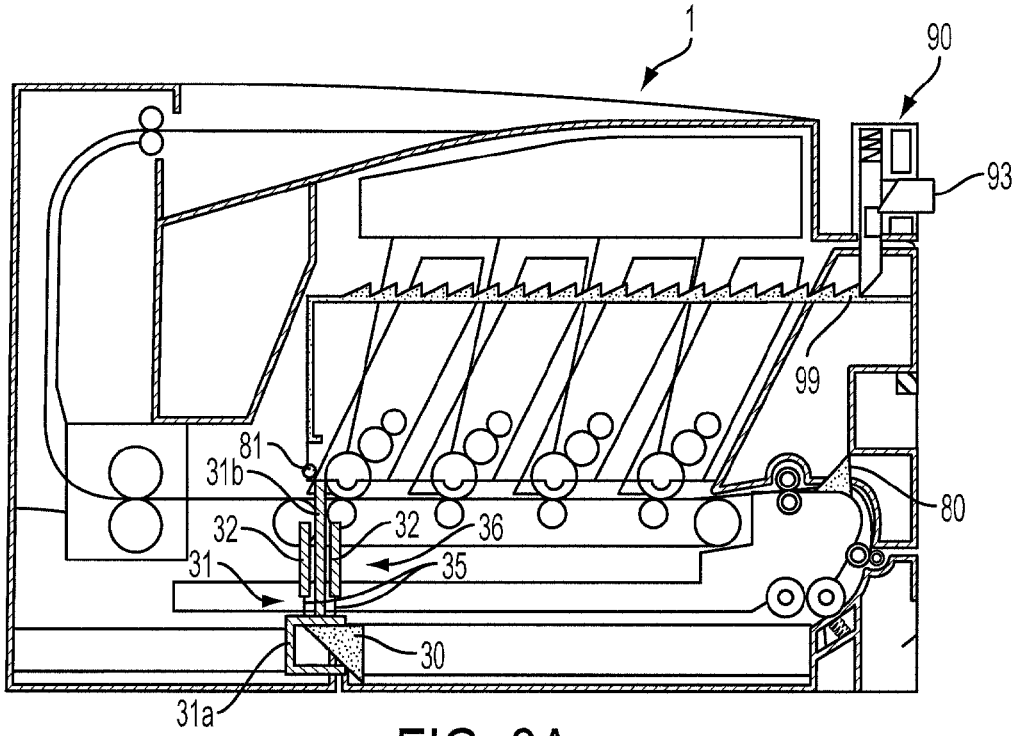
FIG. 8A is an enlarged sectional view of a fourth illustrative example drawer lock of the image forming device of FIG. 1 shown in a locked state in accordance with aspects of the present invention.
Figure 8B:
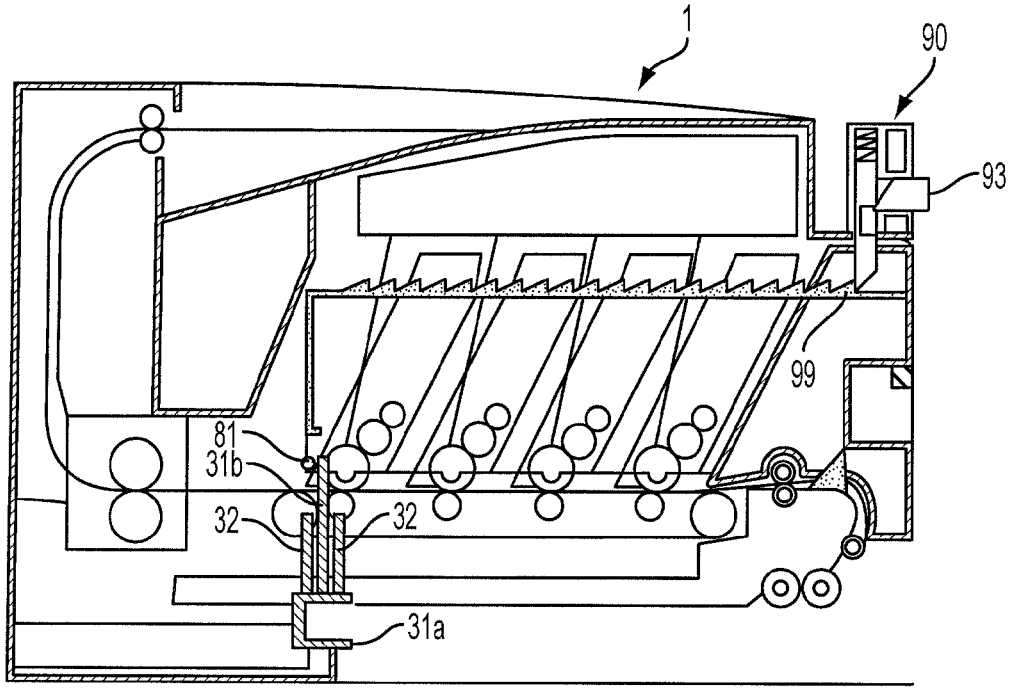
FIG. 8B is an enlarged sectional view of the drawer lock of FIG. 8A shown in a released state in accordance with aspects of the present invention.

9. Illustrative Operation of the Printer 1 Having a Fourth Illustrative Example Drawer Lock As shown in FIGS. 8A and 8B, the fourth illustrative example drawer lock generally adds a preventing structure 36 to the first illustrative example drawer lock described above. FIG. 8A is a central sectional view of the printer 1 when the preventing component 31 is in the locked position. FIG. 8B is a central sectional view of the printer 1 when the preventing component 31 is in the released position.

As shown in FIGS. 8A and 8B, on the rear end of the paper cassette 12 is a wedge-shaped protruding component 30 formed in such a way as to protrude toward the rear.

The preventing structure 36 has the protruding component 30, the preventing component 31, rails 32, tension springs 35, and the protrusion 81. The preventing component 31 is formed in the housing 2 of the printer 1 to prevent the process casing 82 from being drawn out because of the preventing component contacting the protrusion 81 of the process casing 82.

The preventing component 31 is U-shaped. The preventing component 31 includes a contacting portion 31*a* contacting the protrusion component 30 and a controlling portion 31*b* extending upward perpendicularly from the upper end of the contacting portion 31*a*. Rails 32 are formed in the housing 2 of the printer 1 to support the controlling portion 31*b* in such a way that the controlling portion can slide vertically. The lower end of the rails 32 and the upper end of the contacting portion 31*a* are linked with each other by the springs 35 so that the preventing component 31 can be pushed upward.

As shown in FIG. 8A, when the paper cassette 12 as the second drawer component is placed in the main body of the printer 1, the protruding component 30 comes into contact with the upper surface of the contacting portion 31*a*, thereby preventing the preventing component 31 from moving upward. In such a state, the process casing 82 can be drawn out.

As shown in FIG. 8B, when the paper cassette 12 is placed outside the main body of the printer 1, the contact between the protruding component 30 and the contacting portion 31*a* is released, with the result that the preventing component 31 moves upward. In such a state, the controlling portion 31*b* comes into contact with the protrusion 81. As a result, the process casing 82 is prevented from being drawn out.

The process casing 82 is prevented from being drawn out when the paper cassette 12 is not placed inside the printer 1, viz., when the printer 1 would tend to incline. As a consequence, one can reduce the possibility that the printer 1 inclines when the process casing 82 is drawn out of the printer 1.

Although the subject matter has been described in language specific to structural features and/or methodological acts, it is to be understood that the subject matter defined in the appended claims is not necessarily limited to the specific features or acts described above. Rather, the specific features and acts described above are disclosed as illustrative forms of implementing the claims. Numerous other embodiments, modifications, and variations within the scope and spirit of the appended claims will occur to persons of ordinary skill in the art from a review of this disclosure.

For example, for the first illustrative example of a drawer lock the first drawer component is the process casing 82. The first drawer component, however, could be the image forming units. Further, for the fourth illustrative example of a drawer lock, the second drawer component is the paper cassette. The second drawer component, however, could be a belt unit having a paper transport belt and an intermediate print-through belt. In addition, for the first illustrative example of a drawer lock, a laser printer is used as an image forming device. An ink jet printer could be used instead, however.

In another illustrative variation, for the first illustrative example of a drawer lock, if the engaging element 94 is in the locked position, the process casing is prevented at all times from being drawn out for a period from the beginning of the process casing being drawn out until the stopper comes into contact with the protrusion 81. This structure is desirable. Gaps, however, can be formed among the engaged element 95. A structure could be such that a multiplicity of engaged portions 99 are placed in the drawing out direction the process casing 82, and the engaged element 95 and the engaging element 94 come into contact with each other at a multiplicity of places. Another structure could be such that the engaging element 94 and the engaged element 95 come into contact with each other only when the process casing is started to be drawn out from the locked state of the drawer lock 90.

What is claimed is:

1. An image forming device comprising:

a housing formed with an opening;

a first drawer configured to be drawn out from the housing through the opening in a first direction during a drawing out period which occurs from the beginning of the first drawer being drawn out from the housing until the first drawer is drawn out from the housing;

a holding portion provided on the housing, the holding portion being configured to be grasped at a time when the first drawer is drawn out;

a drawer lock configured to be switched between a locked state and a released state, such that movement of the first drawer in the first direction is regulated at the beginning of the movement when the drawer lock is in the locked state and during at least a portion of the drawing out period after the beginning of the first drawer being drawn out, while the movement of the first drawer in the first direction is allowed when the drawer lock is in the released state; and a control element provided in the drawer lock, the control element being configured to be operable while the holding portion is grasped, wherein the drawer lock is in the released state when the control element is in operation, and the drawer lock is in the locked state when the control element is not in operation, wherein the control element is provided above the opening.

2. The image forming device according to claim 1, wherein the drawer lock further comprises:

an engaging element provided in the housing, the engaging element being arranged so as to be switched between a locked position and a released position;

an engaged element provided in the first drawer; and a biasing element providing a force that urges the engaging element toward the locked position;

wherein the engaging element is configured to contact the engaged element at least at the beginning of the movement of the first drawer in the first direction when the engaging element is in the locked position and during at least a portion of the drawing out period after the beginning of the drawer being drawn out, and wherein the engaging element is controlled by the control element such that the engaging element is switched to the released position against the force from the biasing element when the control element is in operation.

3. The image forming device according to claim 1, further comprising:

a first stopper mechanism that regulates the first drawer to be drawn out from the housing, wherein the first stopper mechanism further comprises:

a stopper element provided in the housing; and a contacting element provided in the first drawer, the contacting element being configured to contact the stopper element.

4. The image forming device according to claim 3, wherein, during the drawing out period, the first drawer has been drawn out from the housing when the stopper element comes into contact with the contacting element.

5. The image forming device according to claim 1, wherein the housing has a vertical wall, the opening being formed in the vertical wall.

6. The image forming device according to claim 5, wherein the control element is provided on the vertical wall.

7. The image forming device according to claim 1, further comprising:

a second drawer provided below the opening, the second drawer being configured to be drawn out from the housing; and a second stopper mechanism configured to prevent movement of the first drawer to be drawn out from the housing unless the second drawer is installed in the housing.

8. The image forming device according to claim 7, wherein the first drawer is configured to accommodate at least one image forming unit and the second drawer is configured to accommodate a stack of paper.

9. The image forming device according to claim 1, wherein the first drawer is configured to accommodate at least one image forming unit.

10. The image forming device according to claim 1, wherein the drawer lock is configured to be switched to the locked state at a plurality of positions along the drawing out period.

11. An image forming device comprising:

a housing forming an opening;

a first drawer configured to be drawn out from the housing in a first direction substantially horizontal during a drawing out period which occurs from the beginning of the first drawer being drawn out from the housing until the first drawer is drawn out from the housing;

a drawer lock configured to be switched between a locked state and a released state, such that movement of the first drawer in the first direction is prevented when the drawer lock is in the locked state, and the movement of the first drawer in the first direction is allowed when the drawer lock is in the released state; and a control element provided in the drawer lock, the control element being configured to force the drawer lock into the released state when the control element is pushed in a second direction opposite to the first direction and to permit the drawer lock to attain the locked state when the control element does not engage the drawer lock, the control element being configured to regulate movement of the first drawer at the beginning of the movement when the drawer lock is in the locked state and during at least a portion of the drawing out period past the beginning of the first drawer being drawn out, wherein the control element is provided above the opening.

12. The image forming device according to claim 11, wherein the drawer lock further comprises:

an engaging element provided on the housing, the engaging element configured to be switched between a locked position and a released position;

an engaged element provided on the first drawer, the engaged element being configured to engage the engaging element; and a biasing element providing a force that urges the engaging element toward the locked position, wherein the engaging element is configured to contact the engaged element at least at the beginning of the movement of the first drawer in the first direction when the engaging element is in the locked position and during at least a portion of the drawing out period after the beginning of the drawer being drawn out, and wherein the engaging element is controlled by the control element such that the engaging element is switched to the released position where the engaging element counteracts the force of the biasing element when the controlling element is pushed in the second direction.

13. The image forming device according to claim 11, further comprising:

a first stopper that regulates the first drawer to be drawn out from the housing, wherein the first stopper mechanism comprises:

a stopper element provided in the housing; and a contacting element provided in the first drawer, the contacting element being configured to contact the stopper element.

14. The image forming device according to claim 13, wherein, during the drawing out period, the first drawer has been drawn out from the housing when the stopper element comes into contact with the contacting element.

15. The image forming device according to claim 11, wherein the housing further comprises:

a vertical wall, the opening being formed in the vertical wall.

16. The image forming device according to claim 15, wherein the control element is provided on the vertical wall.

17. The image forming device according to claim 11, further comprising:

a second drawer provided below the opening, the second drawer being configured to be removable from the housing; and a second stopper mechanism configured to prevent the first drawer from being drawn out from the housing unless the second drawer is installed in the housing.

18. The image forming device according to claim 17, wherein the first drawer is configured to accommodate at least one image forming unit and the second drawer is configured to accommodate a stack of paper.

19. The image forming device according to claim 11, wherein the first drawer is configured to accommodate at least one image forming unit.

* * * * *

UNITED STATES PATENT AND TRADEMARK OFFICE

CERTIFICATE OF CORRECTION

PATENT NO. : 7,647,003 B2
APPLICATION NO. : 11/470044
DATED : January 12, 2010
INVENTOR(S) : Nao Itabashi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 479 days.

Signed and Sealed this

Twenty-eighth Day of December, 2010

David J. Kappos

David J. Kappos
*Director of the United States Patent and Trademark Office*